United States Patent [19]

Ingersoll et al.

[11] Patent Number: 4,479,481

[45] Date of Patent: Oct. 30, 1984

[54] WOOD FUEL HEATING APPARATUS AND COMBUSTION PROCESS

[76] Inventors: Charles S. Ingersoll, Ridge Rd., Centerbrook, Conn. 06426; E. Peter Schellens, South Cove Farm, Essex, Conn. 06420

[21] Appl. No.: 292,691

[22] Filed: Aug. 13, 1981

[51] Int. Cl.[3] ..... F24B 5/00

[52] U.S. Cl. ..... 126/76; 126/72; 126/109; 126/144; 126/110 A; 110/315; 122/158

[58] Field of Search ..... 126/73, 76, 77, 101, 126/103, 144, 146, 361, 362, 367, 368, 147, 151, 109, 110 A, 400; 122/2, 15, 16, 17, 135 R, 135 F, 136 R, 158; 110/210, 211, 315

[56] References Cited

U.S. PATENT DOCUMENTS

| | | | |
|---|---|---|---|
| 96,885 | 11/1869 | Clark | 122/51 |
| 1,570,685 | 1/1926 | Larrabee | 126/285.5 |
| 1,713,729 | 5/1929 | Williams | 122/135 R |
| 1,769,497 | 7/1930 | Davidson | 126/110 A |
| 2,911,957 | 11/1959 | Kumm | 122/16 |
| 3,266,466 | 8/1966 | Fehr | 122/136 R |
| 4,078,541 | 3/1978 | Roycraft | 126/77 |
| 4,278,067 | 7/1981 | Pike | 126/103 |
| 4,292,950 | 10/1981 | Schossow | 126/110 A |

FOREIGN PATENT DOCUMENTS

| | | | |
|---|---|---|---|
| 90796 | 1/1896 | Fed. Rep. of Germany | 110/315 |

*Primary Examiner*—Samuel Scott
*Assistant Examiner*—Noah Kamen
*Attorney, Agent, or Firm*—Prutzman, Kalb, Chilton & Alix

[57] ABSTRACT

A boiler having a downdraft solid fuel firebox with a refractory hearth structure with a plurality of parallel internal conduits forming an internal combustion chamber, a heat exchanger below the firebox connected to the outlet of the internal combustion chamber, an outlet blower connected to the outlet of the heat exchanger and an air inlet valve controllable with the outlet blower to control the induction of air through the boiler for automatic boiler control.

35 Claims, 9 Drawing Figures

WOOD FUEL HEATING APPARATUS AND COMBUSTION PROCESS

DESCRIPTION

1. Technical Field

The present invention relates generally to a new and improved wood fuel heating apparatus and combustion process useful for example for space heating and relates more particularly to a new and improved wood fuel heating apparatus and combustion process which provides essentially complete combustion of wood fuel.

The combustion of wood is essentially a two step process. The first step is the destructive distillation of the wood by heating it to or above its kindling temperature to distill off combustion gases. In the second step of the combustion process, air is supplied to the distilled combustible gases for combustion, thereby producing the heat required for continuing the destructive distillation step. To provide complete combustion of the distilled combustible gases, there must be sufficient turbulence for thoroughly mixing the air with the combustible gases and the gas and air mixture must remain in the combustion zone for a sufficient time interval and at a sufficiently high temperature to completely burn. However, in most wood burning apparatus, including boilers and other heating apparatus, the foregoing combustion process does not take place completely in that most of the distilled gases are not adequately mixed with air and are not subjected to a sufficiently high temperature for a sufficiently long period to ensure complete combustion. Consequently, a large volume of incompletely burned gases is present in the exhaust of most wood burning apparatus with the result that creosote deposits and the like are produced which create many well known problems characteristic of conventional wood burning apparatus.

2. Disclosure of the Invention

It is a principal purpose of the present invention to provide a new and improved wood fuel heating apparatus and combustion process in which the wood fuel gasification takes place in a first gasification zone and the gases distilled therefrom are burned within a second combustion zone at an elevated temperature and with sufficient turbulence and for a sufficient time to ensure substantially complete combustion.

Another purpose of the present invention is to provide a new and improved wood fuel heating apparatus and combustion process which provides a predetermined optimum rate of inlet air for complete combustion. In accordance with the present invention, the wood fuel heating apparatus and combustion process has only two principal modes of operation, a combustion mode of operation during which a predetermined optimum rate of inlet air is provided for complete combustion and a non-combustion or dormant mode of operation between combustion modes during which the wood fuel heating apparatus and combustion process remain in a ready status for selecting combustion mode operation. In the combustion mode, complete combustion is provided. In the dormant mode, combustion is terminated altogether (or in the alternative in some applications is continued at a very low rate) so that in both modes creosote deposits and the like are virtually eliminated.

In accordance with the present invention, a new and improved heating apparatus and combustion process are provided for burning wood so as to prevent the deposit of creosote and other undesirable products in its exhaust ducting or internal parts and which provides a high heat output through essentially complete combustion of the wood fuel.

The present invention employs a new and improved combustion chamber and combustion process which provides for gasification of the wood fuel, turbulent mixing of the volatile gas with air and combustion of the gas at a relatively high temperature and for a sufficiently long duration to ensure essentially complete combustion.

The wood fuel heating apparatus of the present invention employs a new and advantageous hearth structure having an internal combustion chamber for combustion of the volatile gas from the wood fuel at an extremely high temperature and thereby to ensure the requisite complete combustion as well as a highly efficient burning process. The heating apparatus also employs an exhaust blower and an on-off air inlet valve in a novel and effective manner which provides for both combustion and non-combustion modes of operation and in its combustion mode a predetermined optimum rate of inlet air for optimum combustion.

The wood fuel heating apparatus of the present invention is most efficiently employed as a wood boiler and is capable of fully burning green and unseasoned wood and pine and other coniferous trees having a large amount of resin. The boiler can also be advantageously designed for burning oil using a generally conventional oil burner as an alternate fuel and whereby either oil or wood can be selectively burned in the multi-fuel boiler as desired are oriented and sized to enhance heat transfer from the products of combustion to the boiler water and to provide a relatively low temperature exhaust (e.g. 300°–400° F.) so that a draft inducing fan may be operated in the exhaust system at a relatively low temperature.

A downdraft turbulent combustion process is provided in a novel and efficient manner which ensures complete combustion during a combustion mode of operation and yet which holds the combustion process essentially dormant in a non-combustion mode of operation. However, the heating apparatus provides for automatically relighting the wood fuel for up to twelve to eighteen hours or more without the use of a pilot light or other auxiliary starting device and whereby the heating apparatus can be automatically operated for space heating and/or supplying domestic hot water in a conventional manner. The wood fuel heating apparatus can be fully charged with wood for automatic or controlled on/off operation for up to 24 hours or more just as effectively and at a substantially lower fuel cost than conventional gas or oil furnaces or boilers. Also, because of its highly efficient wood burning process, the wood boiler operates at a substantially lower fuel cost than other known wood fuel heating apparatus.

Other advantages and features of the present invention will be in part obvious and in part pointed out more in detail hereinafter.

A better understanding of the present invention will be obtained from the following detailed description and the accompanying drawings of an illustrative application of the present invention.

BEST MODE FOR CARRYING OUT THE INVENTION

Figure 2:
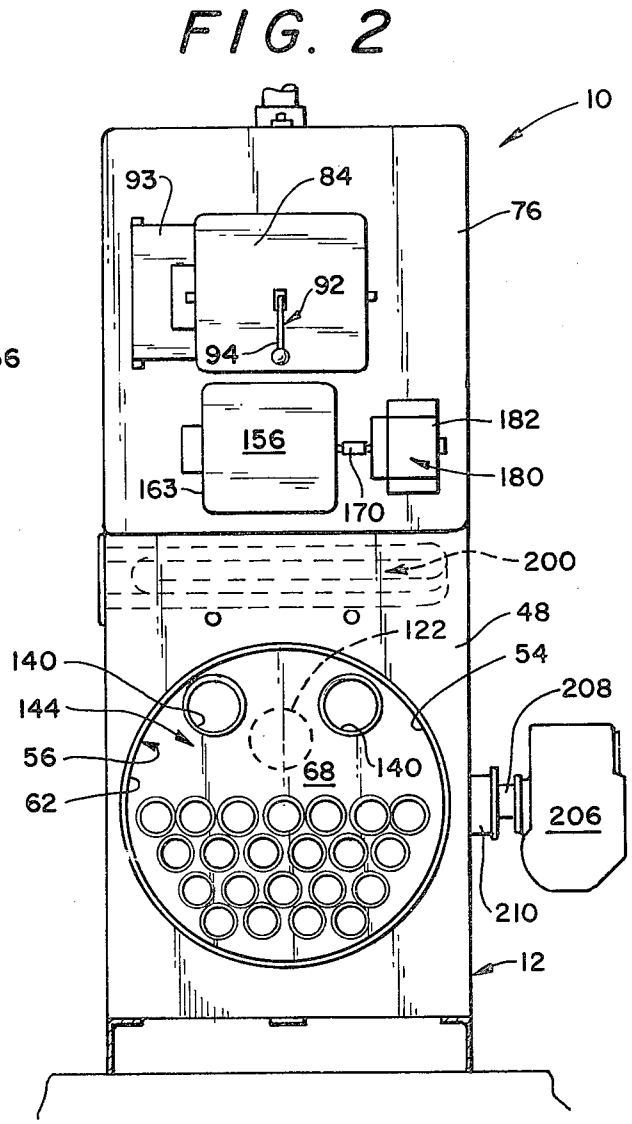
FIG. 2 is a front elevation view, partly broken away and partly in section, of the multi-fuel boiler.
Figure 1:
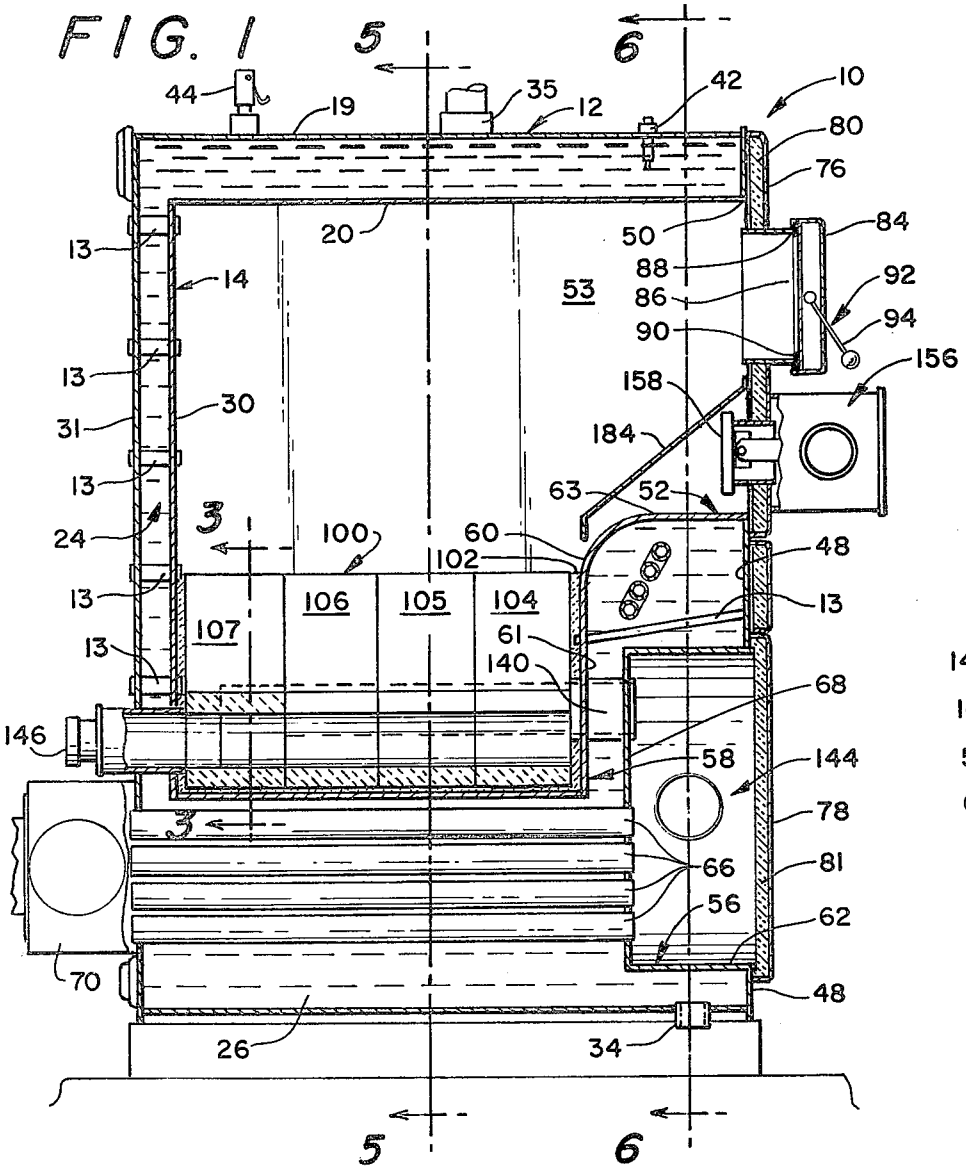
FIG. 1 is a side elevation section view, partly broken away and partly in section, of a multi-fuel boiler incorporating an embodiment of a wood fuel heating apparatus and combustion process of the present invention.
Figure 3:
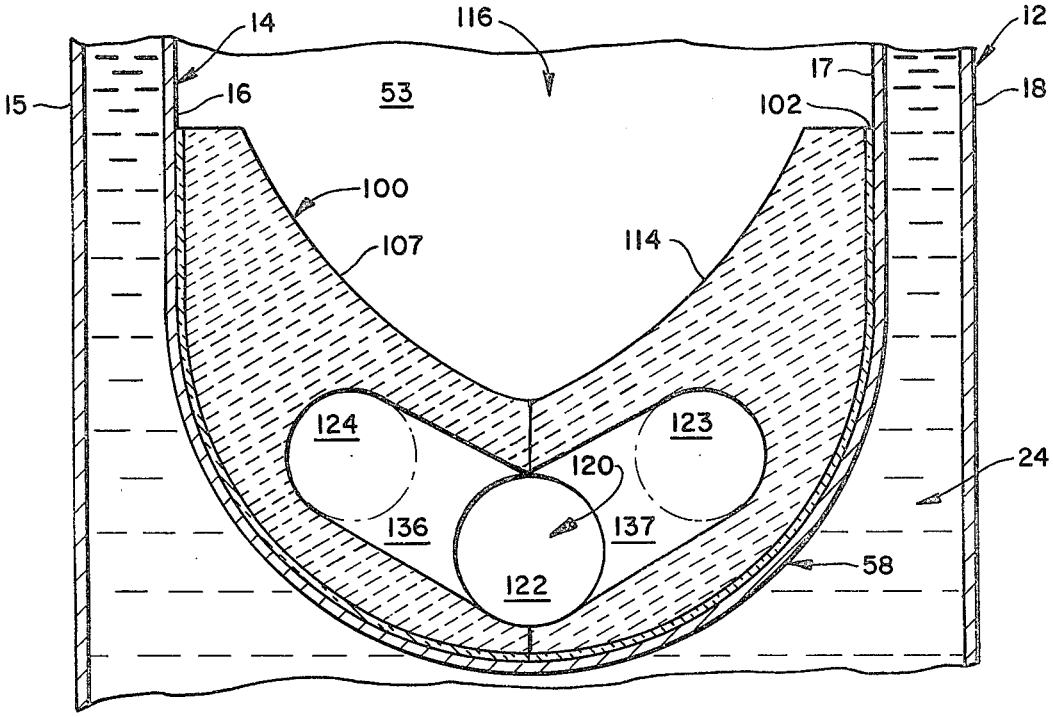
FIG. 3 is an enlarged partial front elevation section view, partly broken away and partly in section, of the multi-fuel boiler, showing a refractory hearth thereof.

Referring now to the drawings in detail wherein like numerals represent like parts throughout, a multifuel downdraft hot water boiler (10) incorporating an embodiment of the heating apparatus of the present invention has an outer boiler shell or pressure vessel (12) and an inner firebox or furnace housing (14), both of heavy gage (e.g. 5/16" thick) welded steel plate construction. Suitable staybolts (13) connected to the inner firebox housing (14) and outer shell (12) strengthen that structure to withstand the internal water pressure of the boiler (10). The inner housing (14) and outer shell (12) have spaced parallel vertical side walls (15–18) and spaced generally semi-cylindrical top and bottom walls (19–22) to form an intermediate water jacket or cavity (24) completely encircling the inner firebox housing (14). A generally constant water jacket thickness is provided between the parallel side walls (15–18) and the semi-cylindrical top walls (19, 20) of the inner housing (14) and outer shell (12). Substantially greater space is provided between the semi-cylindrical bottom walls (21,22) of the inner housing (14) and outer shell (12) to provide a large heat exchanger or fire tube cavity (26) below the firebox housing (14). Spaced flat, parallel rear end plates (30,31) of the inner housing (14) and outer shell (12) provide for extending the water jacket (24) around the rear end of the firebox housing (14). Water inlet and outlet conduits (34,35) are provided at the bottom and top respectively of the boiler shell (12) and so that the water jacket (24) remains full of water under suitable water pressure. Also, additional openings are provided at the top of the boiler shell (12) for a suitable aquastat (42) for sensing the water temperature and for a suitable pressure relief valve (44).

The outer boiler shell (12) has a front flat end plate (48) with an upper opening (50) dimensioned for receiving a top forward projection (52) of the inner firebox housing (14) to provide access to the inner firebox chamber (53) for loading wood fuel and admitting air. A lower circular opening (54) in the front end plate (48) of the boiler shell (12) is dimensioned for receiving a short cylindrical reversing chamber housing (56), also of welded steel plate construction. The reversing chamber housing (56) is mounted directly below the top front projection (52) of the inner firebox housing (14) and partly in front of a lower and shorter section (58) of the firebox housing (14). A formed steel plate (60) provides both the front flat vertical end wall (61) of the lower section (58) of the firebox housing (14) and a flat horizontal bottom wall (63) of the top front projection (52) of the firebox housing (14). The top front projection (52) of the firebox housing (14) and a cylindrical rim (62) of the reversing chamber housing (56) are welded around their entire perimeter to the front end plate (48) of the outer boiler shell (12). The water jacket or cavity (24) extends around the front end wall of the lower section (58) of the firebox housing (14) as well as around its bottom, side and rear end walls.

A large plurality of for example twenty-two horizontal heat transfer or fire tubes (66) are provided in the lower heat exchanger cavity (26) between rear end plates (68,31) of the reversing chamber housing and boiler shell (12), and an outlet duct (70) is mounted externally on the rear end plate (31) of the boiler shell (12) in communication with the rear ends of the fire tubes (66).

A pair of removable heavy gage steel access covers (76,78) are provided on the front end plate (48) of the boiler shell (12) for enclosing the front end openings (50,54) of the firebox housing (14) and the lower reversing chamber housing (56). Suitable high temperature seals (80,81) are provided around the periphery of the access covers (76,78) to make those covers air tight. A loading door (84) is pivotally mounted on the upper access cover (76) to provide convenient access to the interior of the firebox housing (14) via a door opening (86) defined by a square outwardly projecting lip or flange (88) of the access cover (76). The pivotal door (84) has an inner peripheral high temperature seal (90) which seats against the flange (88) to make the door opening (86) air tight when the door (84) is closed. A suitable door closure latch (92) is preferably used which employs a latching device on both sides of the door (84) for positively holding the door (84) inwardly into engagement with the flange (88). Also, the door support hinge (93) is made sufficiently flexible to permit the door to be firmly seated against the flange (88) by the door closure latch (92). A pivotal latch operating handle (94) is also used for opening and closing the door (84).

An elongated generally U-shaped refractory hearth (100) is mounted within the lower portion (58) of the firebox housing (14) so that its bottom, side, front and rear end walls are substantially completely surrounded by the water jacket (24). A suitable insulating liner (102) is provided between the refractory hearth and the firebox housing (14) to reduce the heat transfer from the hearth (100) through the adjacent housing wall and thereby also to reduce the temperature gradient within the hearth (100) and any likelihood of refractory hearth structure cracking during operation of the hot water boiler (10). The refractory hearth (100) is provided by four transverse sections (104–107) (each composed of two molded bricks) having front and rear generally flat parallel side walls and which together provide a substantial refractory mass having for example a length of 24 inches, a width of 18 inches, a height of 14 inches, and a total weight of about 200 pounds.

A downdraft air induction system is employed for burning wood fuel in the firebox from the bottom of the wood charge. As hereinafter more fully explained, combustion takes place both immediately above and within the hearth (100) and so that the hearth (100) is heated to about 1350° F. or higher. The upper surface (114) of the refractory hearth is made concave to provide for focusing radiant energy from the high temperature hearth (100) onto a fuel heating zone (116) immediately above or within the concave pocket or recess of the hearth (100) (and which for example is about 8 to 10 inches above the bottom centerline of the upper concave surface (114) of the hearth). Also, the upper hearth surface curvature preferably has a shape, e.g. a parabolic, circular or other arcuate shape, for efficiently focusing radiant energy from the hearth (100) onto the heating zone (116).

An elongated combustion chamber (120) is provided within the refractory hearth structure (100) by three elongated, parallel combustion chamber conduits or bores (122–124) which extend horizontally parallel to the front-to-rear centerline of the hearth (100). The central elongated combustion chamber conduit (122) has a diameter of for example 4 inches which is slightly larger than the diameter of for example 3½ inches of each of the remaining two outer conduits (123,124). The central conduit (122) extends the full length of the hearth (100) and is connected to the upper concave surface (114) of the hearth by an elongated, parallel entrance slot (126). The entrance slot (126) extends generally tangentially from the central combustion chamber conduit (122) and slopes upwardly and laterally to the upper hearth surface (114) so that the slot inlet (128) is slightly offset from the bottom centerline of the upper hearth surface (114). The entrance slot (126) has an intermediate throat (130) with an optimum width of approximately ¾ inch and has a length of for example 18 inches and extends across the front three transverse sections (104–106) of the hearth (100) (which are preferably identical for simplicity of manufacture). The entrance slot (126) is rounded along its upper and lower edges and has a slightly converging inlet (128) and a slightly diverging outlet (134).

For increased structural rigidity, a plurality of spaced refractory bridge segments (not shown) may be provided along the slot (126) to divide the slot into a plurality of spaced openings or nozzles, in which event the throat width is preferably increased sufficiently to offset the reduced inlet opening.

The two outer elongated combustion chamber conduits (123, 124) extend across the front three transverse sections (104–106) of the hearth (100) and across about two-thirds of the rear hearth section (107). Also, the rear hearth section (107) is formed with a pair of cavities (136,137) in its front face or connecting the rear outlet end of the center conduit (122) with the rear inlet ends of the two outer combustion chamber conduits (123,124). A pair of 4" steel outlet tubes or pipes (140) are mounted within openings in the front end wall (61) of the lower section (58) of the firebox housing (14) and a rear end wall (68) of the reversing chamber housing (56) in alignment with the two outer hearth conduits (123,124). The two outlet tubes (140) thereby provide for connecting the outlet ends of the two outer hearth conduits (123, 124) to the reversing chamber. Accordingly, an elongated double pass combustion chamber (120) having a total length of about 44 inches is formed within the refractory hearth (100) between the inlet slot (126) and the two outlet tubes (140). A rear inspection peep or sight tube (146) having a suitable transparent outer window is provided in alignment with the center elongated combustion chamber conduit (122) for visual inspection of the combustion process within the center conduit (122) and to permit cleaning the center conduit (122) as necessary.

The hot exhaust gases from the two combustion chamber outlet tubes 140 are conducted via the reversing chamber to the fire tubes (66) for the transfer of heat to the water within the boiler shell (12). A large number of fire tubes (66) are provided to reduce the rate of exhaust gas flow through each tube (66) and thereby provide adequate time for the desired heat transfer to the boiler water and for cooling the hot exhaust gases to the desired boiler outlet temperature of for example about 300°–400° F.

An exhaust or outlet blower (150) is mounted on the rear outlet duct (70) for conducting the spent exhaust gases from the fire tubes (66) at a slight positive pressure to a suitable exhaust stack or conduit (not shown). The induced flow provided by the outlet blower (150) provides a predetermined and negative blower inlet pressure of for example between −0.8 to −0.9 inches of water and therefore a predetermined flow rate through the boiler (providing an inlet air flow equal to a linear flow rate of 1,200 ft./min. in a four inch pipe).

Figure 4:
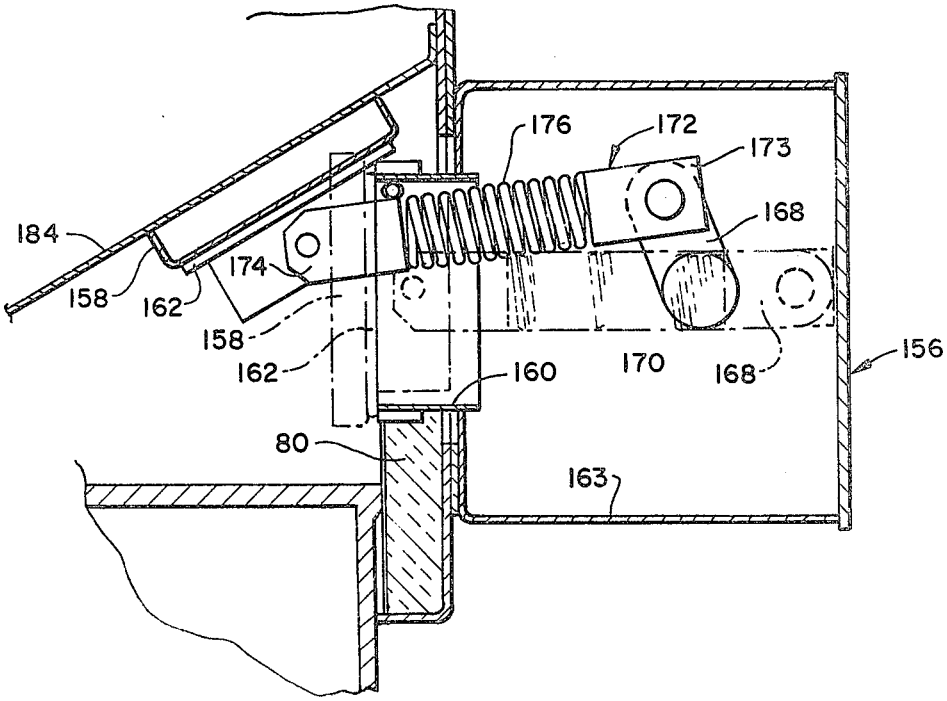
FIG. 4 is an enlarged partial side elevation section view, partly broken away and partly in section, of the multi-fuel boiler, showing an air inlet valve thereof.
Figure 6:
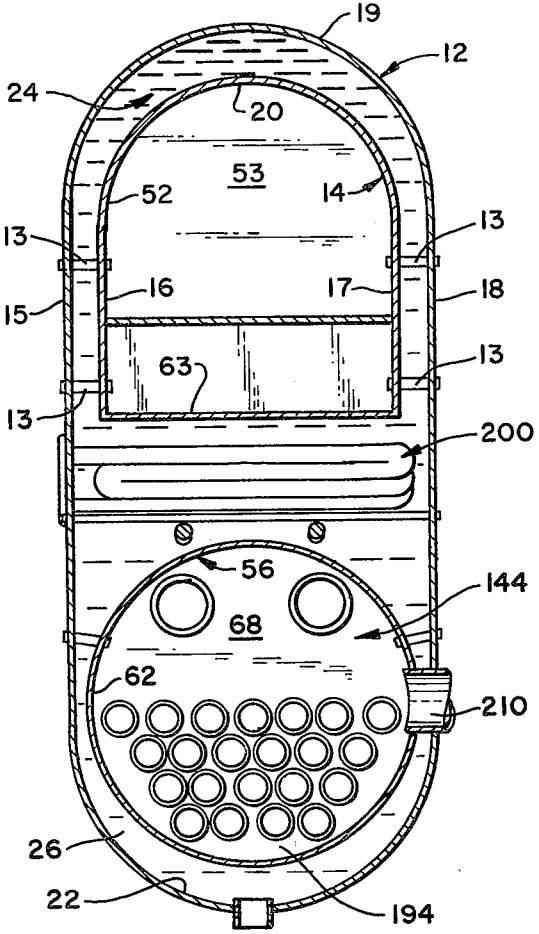
FIGS. 5 and 6 are front elevation section views, partly broken away and partly in section, of the multi-fuel boiler taken substantially along lines 5—5 and 6—6 of FIG. 1.
Figure 5:
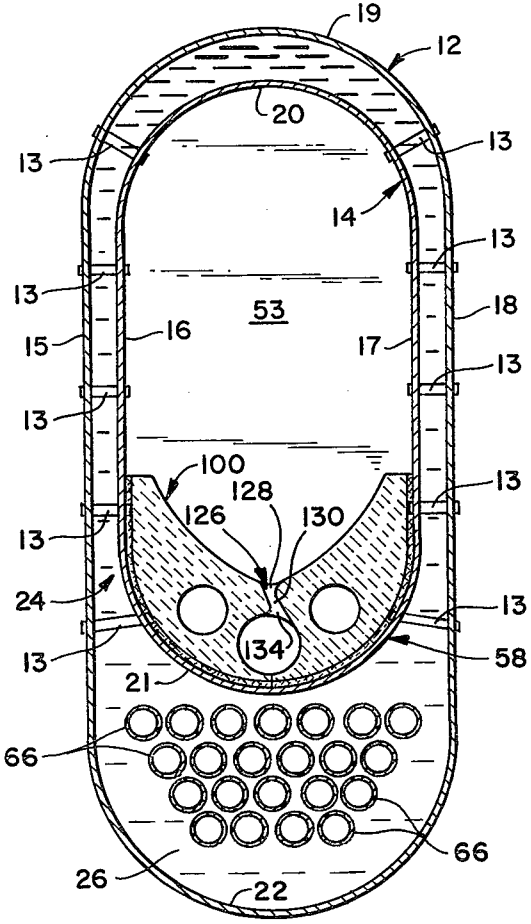
Figure 8:
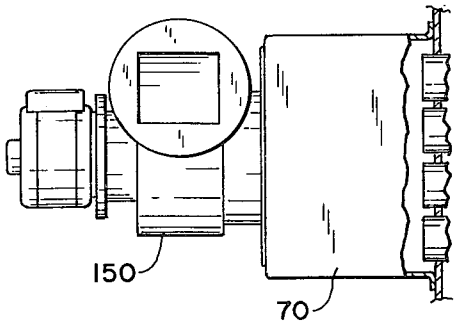
FIG. 8 is a partial side elevation view, partly broken away, of the multi-fuel boiler, showing an outlet blown thereof.
Figure 7:
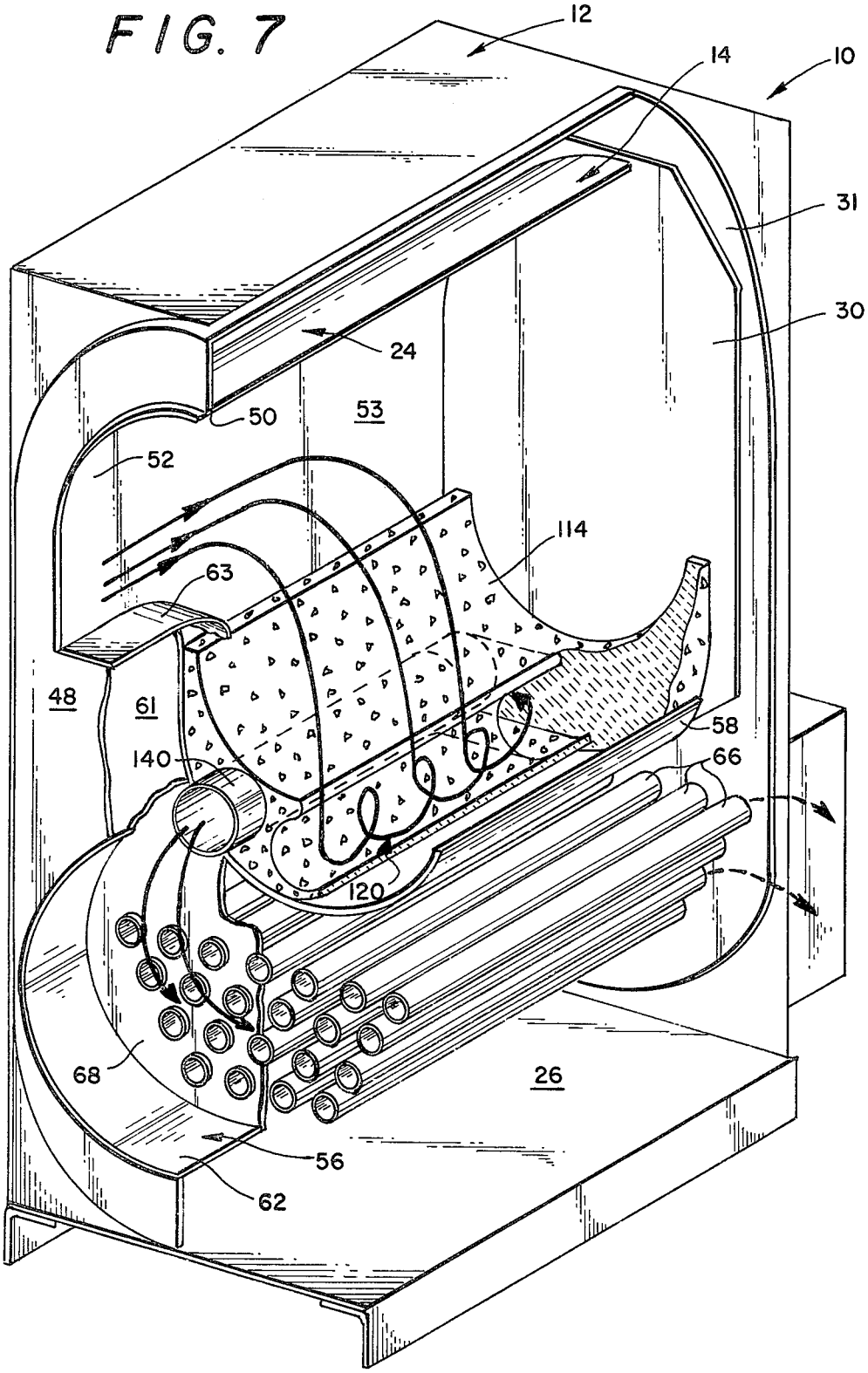
FIG. 7 is an enlarged perspective representation, partly broken away and partly in section, of the multi-fuel boiler, illustrating the air/gas fluid flow within the boiler.
Figure 9:
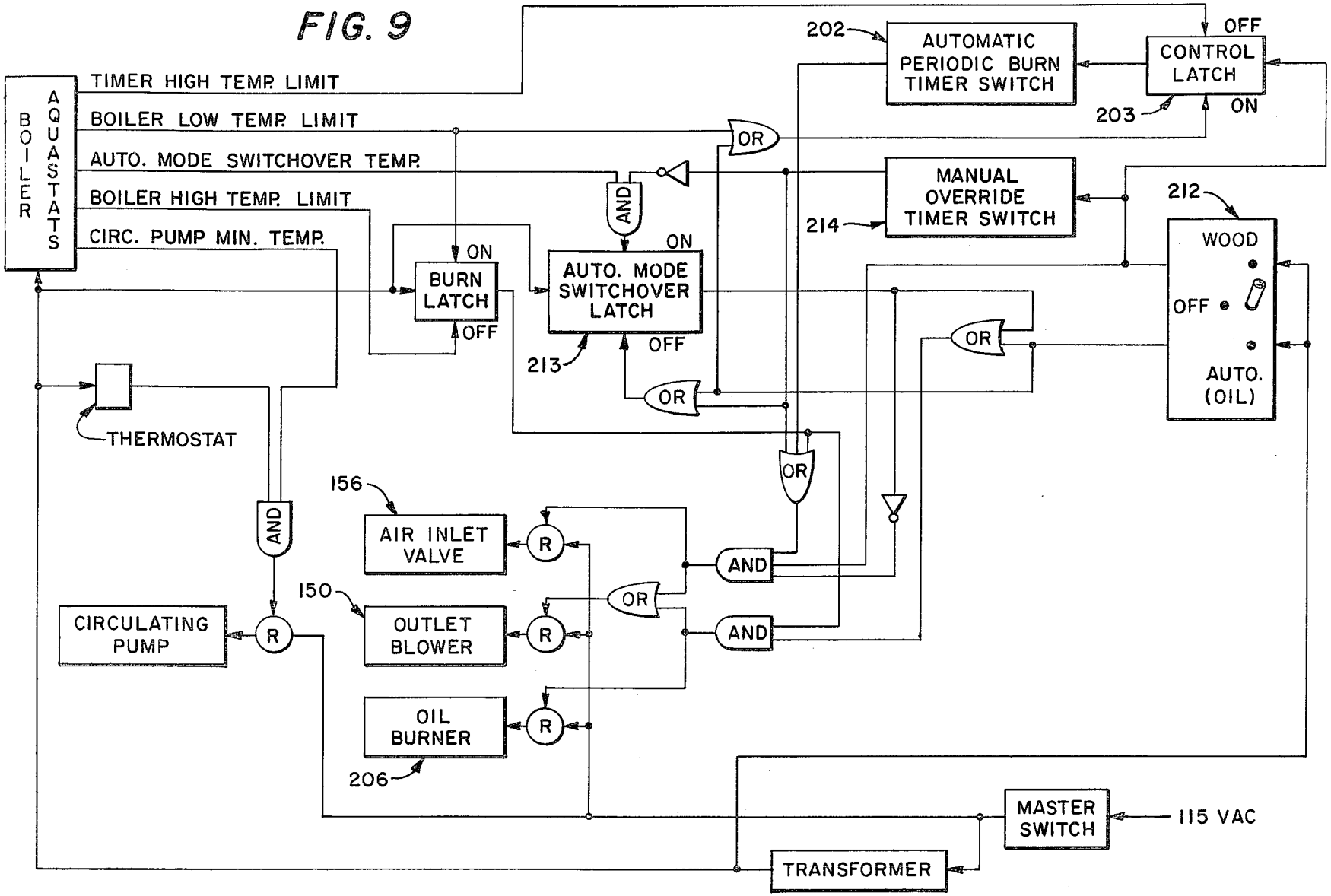
FIG. 9 is a generally diagrammatic illustration showing a control system of the multi-fuel boiler.

A motor operated air inlet valve (156) is mounted on the upper access cover (76) below the loading door (84). A valve member (158) is pivotally mounted on an inner rectangular flange or lip (160) of a valve housing (163) to pivot inwardly into the firebox housing (14). The valve member (158) has a suitable high temperature seal (162) for engaging the valve seat provided by the inner edge of the flange (160) to completely seal the air inlet opening when the valve member (158) is closed. The valve member (158) is operated by a crank arm (168) on an electric motor drive shaft (170). The crank arm (168) is connected to the valve member (158) by an extendable connecting rod (172) having a pair of telescoping end sections (173, 174) interconnected by a tension coil spring (176). With the crank arm (168) in its outer closed position shown in broken lines in FIG. 4 the connecting rod (172) is extended slightly against the bias of the tension spring (176) to hold the valve member (158) tightly against its valve seat. When the electric motor (180) is energized, the motor shaft (170) rotates approximately 120° (in the counterclockwise direction as viewed in FIG. 4) to pivot the valve member (158) inwardly to its open position shown in full lines in FIG. 4. When the motor (180) is deenergized (and to provide fail-safe operation if power is lost), a suitable return spring (not shown) within the motor housing (182) rotates the motor shaft (170) in the opposite direction to close the valve member (158). A rearwardly and downwardly inclined sheet metal baffle (184) is mounted within the firebox housing (14) inwardly of the valve member (158) to protect the valve member (158) and to direct the inlet air downwardly and rearwardly toward the refractory hearth (100).

Accordingly, the air inlet valve (156) when energized, opens the valve member (158) fully to provide in conjunction with the exhaust blower (150) a designed inlet air flow rate providing optimum boiler operation. When the inlet valve (156) is deenergized, the inlet valve member (158) is tightly closed to terminate combustion within the boiler (10). However, the refractory hearth (100) remains sufficiently hot for up to twelve to eighteen hours or more for continuing the combustion process merely by reenergizing the inlet valve (156) and exhaust blower (150). The exhaust blower (150) induces a high inlet air flow rate through the remnant hot coals on the hearth (100) to rapidly initiate combustion and accelerate the combustion rate to the designed operating level of the boiler (10).

In operation, the outlet blower (150) and an inlet valve (156) are connected to be simultaneously energized to activate the heating apparatus (10). Air is thereby induced into the firebox housing (14) at a predetermined optimum rate to provide oxygen for combustion. Initially, a small fire is started on the hearth (100), for example using suitable kindling. Then the fuel charge chamber (53) is loaded with logs, scrap wood, etc. and the loading door (84) is closed. With the downdraft air flow, the starter kindling is rapidly burned to heat the refractory hearth (100) and bake the wood charge in the heating zone (116) generally at the top of the hearth cavity to distill highly inflammable gases from the wood charge in the heating zone (116). The inflammable gases are distilled from the wood by the heat from the bed of hot coals on the refractory hearth (100) and from the radiant heat from the hearth (100). The inflammable gases are drawn downwardly through the entrance slot (126) into the elongated combustion chamber (120) within the hearth (100). The inflammable gases are ignited as they are drawn downwardly through the bed of hot coals on the hearth (100) and are completely burned at an elevated temperature within the elongated internal combustion chamber (120) of the hearth (100) as the gases are drawn through that combustion chamber (120). A high velocity turbulent flow of the gases and entrained fuel particles is provided within the internal combustion chamber (120) by its nozzle-like entrance slot (126) and by the vortex flow within the central combustion chamber (122) induced by the inward high velocity tangential flow therein. Thus the combustible gases flow tangentially into the refractory hearth combustion chamber (120), causing a helical or swirling motion which greatly improves the mixing of the combustible gases with air. The hearth (100) is rapidly heated to 1,350° F. or higher and the double pass gas flow through the high temperature hearth (100) provides a relatively long or prolonged burning interval at a temperature of up to 2,250° F. or higher to assure substantially complete combustion and so that only a fly ash residue remains. The long double pass combustion chamber (120) within the refractory hearth (100) has an effective length of between about 24 to 44 inches, depending on the starting point along the slot (126), to provide a relatively long or prolonged combustion time interval in a high temperature and turbulent environment. From experience, it has been found that the minimum 24 inch length in the described configuration provides a sufficient time interval for achieving the desired complete combustion. The result is a virtually smokeless, odorless, non-creosote producing combustion process. The hot products of combustion exiting from the hearth (100) have a temperature of approximately 1,850° F. for heating the boiler water as they pass into the reversing chamber (144) and thence through the fire tubes (66). Most of the unburned fly ash residue is carried from the boiler (10) by the exhaust gases and experience has shown that the fire tubes (66) remain very clean. Fly ash accumulates only at a very low rate in a bottom residue cavity (194) of the reversing chamber (144), and the reversing chamber access cover (78) can be removed periodically to remove any collected fly ash residue and to inspect and clean if necessary the fire tubes (66).

A very important advantage of the downdraft boiler (10) is its automatic restarting capability for up to twelve to eighteen hours or more after its last combustion cycle and even though between combustion cycles, the air inlet valve (156) is completely closed and the combustion process is dormant due to the lack of oxygen. However, the remnant hot coals on the hearth (100) remain sufficiently hot to relight the boiler after a long period of time. The hot refractory hearth (100) keeps the bed of coals hot and also aids in relighting the fire by focusing its radiant energy onto the wood fuel immediately above the bed of remnant hot coals. Accordingly, the downdraft boiler (10) can be operated on demand merely by energizing the outlet blower (150) and inlet valve (156).

The downdraft boiler (10) shown has a relatively large 10.5 cu ft. charge chamber (53) for storing up to 24 hours of wood fuel, depending of course on the length and frequency of the burning cycles. In view of the downdraft operation of the boiler (10), the wood fuel is burned only from the bottom of the wood charge and the wood charge above the heating or distillation zone (116) is generally unaffected by the burning process and is maintained relatively cool by the surrounding water jacket (24).

The boiler (10) is shown having a domestic hot water heat exchanger (200) mounted within the water jacket (24) above the reversing chamber housing (56). Boiler operation is controlled by the boiler aquastat (42) in a generally conventional manner to activate and deactivate the boiler (10) to hold the boiler water temperature within a predetermined given temperature range. The boiler (10) is controlled in essentially the same manner when used for space heating, when used both for space heating and supplying domestic hot water, and when used only for supplying domestic hot water as in the summertime. If boiler operation is not required over an extended period of time, as for example when it is used in the summertime only for supplying domestic hot water, the boiler control system preferably employs a suitable automatic timer (202) for operating the boiler (10) (i.e. energizing the exhaust blower (150) and air inlet valve (156)) for approximately ten minutes every three hours to maintain the internal boiler temperature sufficiently high for continuing automatic restarting. Also, a control latch (203) is provided for deactivating the timer (202) when the boiler temperature reaches a predetermined boiler high temperature limit. The control latch 203 is reset to reactivate the timer (202) when the boiler temperature drops to the low temperature limit of its operating range. In addition, if desired for some applications, small air inlet apertures (not shown) can be provided for example in the firebox housing access cover (76) to provide a very low but continuous burning rate even when the air inlet valve (156) and outlet blower (150) are deenergized A suitable conventional oil burner (206) is mounted on the side of the boiler shell (12) with the oil burner nozzle (208) extending into a connecting tube or collar (210) for alignment with a horizontal diametral axis of the cylindrical reversing chamber (144). The oil burner (206) may be used in lieu of a wood fire to provide for automatic boiler operation, for example during a relatively long period of time when a house is unoccupied. A suitable three position selector switch (212) is provided for selecting either oil burner ("auto") or wood burner modes of operation and for turning the boiler off. In the wood burner mode, the boiler (10) would be operated as described. In the oil burner mode, the outlet blower (150) would be operated in conjunction with the oil burner (206) and the air inlet valve (156) would remain closed. Also, when in the wood burner mode, an aquastat controlled latch (213) provides for automatically switching to the oil burner ("auto") mode when the boiler drops to a predetermined low temperature which indicates the wood fire is out.

A suitable manually operated timer switch (214) is provided, preferably on the firebox access cover (76), for manually energizing the air inlet valve (156) and outlet blower (150) before the firebox loading door (84) is opened. The outlet blower (150) and air inlet valve (156) can thereby be maintained energized for a manually set period of time for starting and to prevent updraft combustion withing the charge chamber (53) and the discharge of smoke through the door opening (86) while the firebox door (84) is open.

As will be apparent to persons skilled in the art, various modifications, adaptations and variations of the foregoing specific disclosure can be made without departing from the teachings of the present invention.

We claim:

1. In a downdraft solid wood fuel heating apparatus comprising a wood firebox having a wood fuel charge chamber for receiving a charge of wood fuel and for generally downdraft combustion of the wood fuel from generally the bottom of the fuel charge chamber, and a heat exchanger having an inlet connected to the firebox for receiving the hot gaseous products of combustion therefrom and a heat exchanger outlet for exhausting the gaseous products of combustion, the improvement wherein the firebox comprises a refractory hearth structure having an outer refractory hearth surface defining in part a combustion zone at generally the bottom of the fuel charge chamber and elongated internal combustion chamber means within the hearth structure and adjacent to said outer hearth surface for prolonged high temperature combustion therein within the hearth structure adjacent to said outer hearth surface and having an outlet end connected to the heat exchanger inlet and a first elongated combustion chamber conduit extending within the refractory hearth structure generally parallel and adjacent to said outer hearth surface, the said first elongated combustion chamber conduit having a transverse width substantially less than the corresponding transverse width of the said outer refractory hearth surface and the refractory hearth structure generally surrounding the said elongated internal combustion chamber means and having a transverse sectional area substantially greater than the corresponding transverse sectional area of the said elongated internal combustion chamber means to provide for said prolonged high temperature combustion within the hearth structure, and inlet means in said outer hearth surface extending longitudinally generally parallel to said first elongated combustion chamber conduit and connecting said combustion zone to said first elongated conduit.

2. In a downdraft solid fuel heating apparatus comprising a firebox having a fuel charge chamber for receiving a charge of solid carbonaceous fuel and for generally downdraft combustion of the fuel from generally the bottom of the fuel charge chamber, and a heat exchanger having an inlet connected to the firebox for receiving the hot gaseous products of combustion therefrom and a heat exchanger outlet for exhausting the gaseous products of combustion, the improvement wherein the firebox comprises a refractory hearth structure having an outer hearth surface defining in part a combustion zone at generally the bottom of the fuel charge chamber and elongated internal combustion chamber means for prolonged high temperature combustion within the hearth structure and having an outlet end connected to the heat exchanger inlet, a first elongated combustion chamber conduit, extending within the refractory hearth structure generally parallel to said outer hearth surface, having an outlet at one end thereof and at least one second elongated combustion chamber conduit generally parallel and adjacent to said first elongated conduit with an inlet end thereof adjacent and connected to said outlet end of said first elongated conduit for series connection of the second conduit thereto, and inlet means in said outer hearth surface connecting said combustion zone to said first elongated conduit.

3. A heating apparatus according to claim 2 wherein the refractory hearth structure comprises at least two of said second elongated combustion chamber conduits in parallel.

4. In a solid wood fuel heating apparatus comprising a wood firebox having a wood fuel charge chamber for receiving a charge of wood fuel and for combustion of the wood fuel, and a heat exchanger having an inlet connected to the firebox for receiving the hot gaseous products of combustion therefrom and a heat exchanger outlet for exhausting the gaseous products of combustion, the improvement wherein the firebox comprises a refractory hearth structure having an outer refractory surface defining in part a combustion zone within the fuel charge chamber, elongated internal combustion chamber means within the hearth structure adjacent to said outer refractory surface for prolonged high temperature combustion within the hearth structure and having an outlet end connected to the heat exchanger inlet and a plurality of elongated combustion chamber conduits, including a first elongated combustion chamber conduit, in side by side relationship within the refractory hearth structure, the said first elongated combustion chamber conduit having a transverse width substantially less than the corresponding transverse width of the said outer refractory hearth surface and the refractory hearth structure generally surrounding the said elongated internal combustion chamber means and having a transverse sectional area substantially greater than the corresponding transverse sectional area of the said elongated internal combustion chamber means to provide for said prolonged high temperature combustion within the hearth structure, and inlet means in said outer surface extending longitudinally generally parallel to and connecting said combustion zone to at least said first elongated conduit.

5. A heating apparatus according to claim 1, 2, 3 or 4 wherein the firebox comprises a firebox housing with a bottom cavity receiving the refractory structure and having outlet conduit means in alignment with the outlet end of the elongated internal combustion chamber means in the refractory structure for connection thereof to the heat exchanger for conducting the products of combustion thereto.

6. A heating apparatus according to claim 1, 2, 3 or 4 wherein the refractory structure comprises a bank of a plurality of abutting hearth sections extending traversely of said first elongated combustion chamber conduit and collectively forming said internal elongated combustion chamber means.

7. A heating apparatus according to claim 1, 2, 3 or 4 wherein the said outer surface of the refractory structure is concave to at least generally focus the heat radiation from the refractory structure onto the fuel charge within a predetermined zone spaced from said outer surface.

8. A heating apparatus according to claim 7 wherein said outer concave surface has a geometric shape to focus the heat radiation from the refractory structure onto the fuel charge within said predetermined zone.

9. A heating apparatus according to claim 1, 2, 3 or 4 further comprising a boiler shell providing a hot water jacket at least partly surrounding the firebox and a hot water heat exchanger cavity receiving the heat exchanger.

10. A heating apparatus according to claim 9 wherein the heat exchanger cavity and heat exchanger are below the firebox, wherein the heating apparatus further comprises a reversing chamber connected between the heat exchanger inlet and the outlet of the elongated internal combustion chamber means in the refractory structure and having a removable access cover opposite the heat exchanger for access to the heat exchanger and said reversing chamber.

11. In a heating apparatus having a wood firebox with a wood combustion chamber for combustion of a solid wood fuel and a heat exchanger having an inlet connected to the combustion chamber for receiving the gaseous products of combustion therefrom and an outlet for exhausting the gaseous products of combustion, the improvement wherein the firebox has a refractory structure with an outer surface defining in part an adjacent combustion zone and wherein the combustion chamber comprises elongated internal combustion chamber means within the refractory structure adjacent to said outer surface for prolonged high temperature combustion within the refractory structure and having an outlet end thereof connected to the heat exchanger, a first elongated combustion chamber conduit extending generally parallel and adjacent to said outer surface, the said first elongated combustion chamber conduit having a transverse width substantially less than the corresponding width of the said outer surface of the refractory structure and the refractory structure generally surrounding the said elongated internal combustion chamber means and having a transverse sectional area substantially greater than the corresponding transverse sectional area of the said elongated internal combustion chamber means to provide for said prolonged high temperature combustion within the hearth structure, and inlet means in said outer surface extending longitudinally generally parallel to said first elongated combustion chamber conduit and connecting said adjacent combustion zone to said first elongated combustion chamber conduit.

12. A heating apparatus according to claim 11 wherein the refractory structure provides a combustion chamber hearth.

13. A heating apparatus according to claim 1, 2, 3, 4 or 11 wherein the inlet means in the outer surface is oriented generally tangentially of the said first elongated conduit to direct gases from the combustion zone generally tangentially into the conduit to create a turbulent vortex flow therein.

14. A heating apparatus according to claim 1, 2, 3, 4 or 11 further comprising an outlet blower connected to the heat exchanger outlet and selectively operable for conducting the gaseous products of combustion therefrom and thereby induce flow through said elongated combustion chamber means in the refractory structure.

15. A heating apparatus according to claim 14 further comprising air inlet valve means for the firebox adapted to be selectively opened and closed for selectively inducing inlet air into the firebox and means for opening the air inlet valve means in conjunction with operation of the outlet blower and closing the inlet valve means in conjunction with discontinuing operation of the outlet blower.

16. In a downdraft solid fuel heating apparatus comprising a wood firebox having a wood fuel charge chamber for receiving a charge of solid wood fuel and a combustion chamber for generally downdraft combustion of the fuel from generally the bottom of the fuel charge chamber, a heat exchanger having a heat exchanger inlet connected to the firebox for receiving the gaseous products of combustion therefrom and a heat exchanger outlet for exhausting the gaseous products of combustion, and an induction system for inducing air into the combustion chamber for said generally downdraft combustion, the improvement wherein the firebox comprises refractory hearth structure means and the combustion chamber comprises elongated internal combustion chamber means within the refractory hearth structure for heating the refractory structure for maintaining the firebox temperature between fuel combustion cycles at least in part with the refractory structure, the elongated internal combustion chamber means having a transverse width substantially less than the corresponding transverse width of the refractory hearth structure means and the refractory structure generally surrounding the said elongated internal combustion chamber means and having a transverse sectional area substantially greater than the corresponding transverse sectional area of the said elongated internal combustion chamber means to provide for said prolonged high temperature combustion with the hearth structure, and wherein the induction system comprises electrically operated air inlet valve means adapted to be selectively energized for selectively opening the inlet valve means for inducing inlet air into the firebox combustion chamber for said generally downdraft fuel combustion, and electrically operated outlet blower means connected to the outlet of the heat exchanger and adapted to be selectively energized for selectively conducting the gaseous products of combustion from the heat exchanger and thereby also induce inlet air flow through the air inlet valve means to the combustion chamber, and electrical control means for selectively energizing the air inlet valve means and outlet blower means for selectively operating the heating apparatus for combustion of fuel within the firebox.

17. In a method of operating a wood fuel heating apparatus comprising a firebox for combustion of wood fuel and having a fuel charge chamber for receiving a charge of wood fuel and a refractory structure with a surface defining in part a firebox combustion zone within the charge chamber, and a heat exchanger having an inlet connected to the firebox for receiving the hot gaseous products of combustion therefrom and an outlet for exhausting the gaseous products of combustion, comprising the steps of gasifying the wood fuel in the fuel charge chamber of the firebox with the heat of combustion from the combustion zone and radiant heat from the refractory structure, and burning the wood fuel gas while conducting the wood fuel gas through the combustion zone and through elongated internal combustion chamber means within the refractory structure adjacent to said combustion zone surface and having a transverse width substantially less than the corresponding transverse width of the refractory structure so that the refractory structure provides prolonged high temperature combustion within the said internal combustion chamber means therein for generally complete combustion of the gas at an elevated temperature of at least 1350 degrees F., and then conducting the hot gaseous products of combustion through the heat exchanger.

18. The method of operating a wood fuel heating apparatus according to claim 17 further comprising the step of exhausting the gaseous products of combustion from the heat exchanger with an outlet blower to provide a generally predetermined rate of flow through the internal combustion chamber means within the refractory structure.

19. The method of operating wood fuel heating apparatus according to claim 17 or 18 further comprising the step of conducting inlet air through the combustion zone and then through the internal combustion chamber means within the refractory structure to ignite the wood fuel gas in the combustion zone and then continue combustion of the wood fuel gas as it is conducted through the internal combustion chamber.

20. In a solid wood fuel heating apparatus comprising a wood firebox having an outer firebox housing with a solid wood fuel charge chamber and adapted for the receipt and combustion of a charge of solid wood fuel, a boiler shell providing a water jacket at least partly surrounding the firebox housing and a water heat transfer chamber, and a heat exchanger in the heat transfer chamber for heating the water within the boiler shell and having an inlet connected to the firebox housing for receiving the hot gaseous products of combustion therefrom and an outlet for exhausting the gaseous products of combustion, the improvement wherein the firebox housing is mounted generally completely within the boiler shell and has an upper portion, secured to the boiler shell, with an outer end enclosure with a wood loading door providing access to the fuel charge chamber, wherein the boiler shell water jacket generally completely surrounds said upper portion of the firebox housing excepting its outer end enclosure, wherein the firebox housing has a lower portion within the boiler shell generally completely surrounded by the water jacket, and wherein the firebox comprises refractory hearth structure means, mounted within said lower portion of the firebox housing, for maintaining the firebox temperature between fuel combustion cycles and elongated internal combustion chamber means within the refractory hearth structure means for prolonged high temperature combustion therein and having an outlet end connected to the heat exchanger inlet, said elongated internal combustion chamber means having a transverse sectional area and transverse width along at least most of the entire length thereof which is substantially less than the corresponding transverse sectional area and transverse width of the refractory hearth structure means, and inlet means in said refractory hearth structure means extending longitudinally generally parallel to said elongated internal combustion chamber means and connecting said fuel charge chamber to said elongated internal combustion chamber means.

21. In a solid wood fuel heating apparatus comprising a wood firebox having a fuel charge chamber for receiving a charge of solid wood fuel and combustion chamber means for generally downdraft combustion of the wood fuel from generally the bottom of a fuel charge within the fuel charge chamber, a heat exchanger having a heat exchanger inlet connected to the firebox for receiving the gaseous products of combustion from the combustion chamber means and a heat exchanger outlet for exhausting the gaseous products of combustion, and an induction system for inducing air into the combustion chamber means for combustion, the improvement wherein the firebox comprises refractory hearth structure means for maintaining the firebox temperature between fuel combustion cycles and wherein said combustion chamber means is provided at least in part by combustion chamber conduit means within the refractory hearth structure means, the said combustion chamber conduit means having a transverse sectional area and transverse width substantially less than the corresponding sectional area and width of the refractory hearth structure means to provide prolonged high temperature combustion within the refractory hearth structure means, and wherein the induction system comprises air inlet valve means adapted to be selectively operated to a fully closed position thereof closing off inlet air therethrough to the combustion chamber means and to a fully open position thereof admitting inlet air generally downwardly to the combustion chamber means, and outlet blower means connected to the outlet of the heat exchanger and adapted to be selectively energized for selectively conducting the gaseous products of combustion from the heat exchanger and thereby also induce inlet air at a generally predetermined rate through the air inlet valve means to the combustion chamber means, and control means for selectively opening the air inlet valve means to its fully open position and energizing the outlet blower means to effect a combustion cycle within the heating apparatus and in the alternative closing the air inlet valve means to its fully closed position and deenergizing the outlet blower means to substantially terminate the combustion cycle within the heating apparatus.

22. A heating apparatus according to claim 21 wherein the refractory hearth structure means is generally below the charge chamber for holding the hot coals from the combustion of fuel within the firebox.

23. A heating apparatus according to claim 20 or 22 wherein the refractory hearth structure means comprises internal, confined combustion chamber means with an outlet end connected to the heat exchanger inlet means and inlet connected to the fuel charge chamber.

24. A heating apparatus according to claim 20 wherein the heat transfer chamber is directly below the firebox housing and the heat exchanger comprises a plurality of elongated horizontally extending fire tubes.

25. A heating apparatus according to claim 23 wherein the internal combustion chamber means has a confined passage between the combustion chamber inlet means and outlet which is at least 24 inches long.

26. A heating apparatus according to claim 23 wherein the internal combustion chamber means has a first elongated combustion chamber conduit and the inlet means extends along and is connected to said first elongated conduit.

27. A heating apparatus according to claim 26 wherein the said first elongated conduit and the said inlet means extend generally horizontally.

28. A heating apparatus according to claim 26 wherein the inlet means comprises slot means having a throat less than 1 inch wide.

29. A heating apparatus according to claim 26 wherein the inlet means extends tangentially of the said first elongated conduit to cause turbulent flow therein.

30. A heating apparatus according to claim 21 or 22 wherein the control means comprises timer means for periodically automatically opening the air inlet valve means and energizing the outlet blower means for a predetermined interval for effecting periodic combustion cycles within the heating apparatus.

31. A heating apparatus according to claim 30 wherein the predetermined interval is about ten minutes.

32. In a method of downdraft combustion of wood fuel within heating apparatus having a firebox with a fuel charge chamber for receiving a charge of wood fuel and having a combustion zone generally at the bottom thereof, a combustion chamber with an inlet connected to the combustion zone and an outlet, and a heat exchanger having an inlet connected to the outlet of the combustion chamber for receiving hot gaseous products of combustion therefrom and an outlet for exhausting the gaseous products of combustion, comprising the steps of providing a generally downdraft air flow within the fuel charge chamber for supplying air to the combustion zone and combustion chamber, distilling gas from the wood fuel in the combustion zone and burning the distilled gas while conducting it through the combustion zone and through a combustion chamber provided by internal confined elongated conduit means within a refractory hearth structure within the firebox and having a length of at least 24 inches and a transverse sectional area and transverse width along at least most of the entire length thereof substantially less than the corresponding transverse sectional area and transverse width of the refractory hearth structure and providing prolonged high temperature combustion within the confined elongated conduit means within the hearth structure with the distilled gas being burned in the confined elongated conduit means with turbulence and at an elevated temperature of at least 1350 degrees F. to provide for generally complete combustion of the gas, and conducting the hot gaseous products of combustion from the combustion chamber and through the heat exchanger.

33. In a heating apparatus having a wood fuel charge chamber for receiving a charge of solid wood fuel, an auxiliary fuel burner adapted to be energized for burning an alternative fuel, combustion chamber means for generally downdraft combustion of the solid fuel from generally the bottom of a fuel charge within the fuel charge chamber and for combustion of the alternative fuel from the auxiliary fuel burner, a boiler with a heat exchanger having a heat exchanger inlet connected to the combustion chamber means for receiving the gaseous products of combustion from combustion of the auxiliary fuel and the solid fuel and a heat exchanger outlet for exhausting the gaseous products of combustion, and an induction system for inducing air into the combustion chamber means for combustion, the improvement wherein the heating apparatus comprises refractory hearth structure means for maintaining the temperature at the bottom of the fuel charge chamber between fuel combustion cycles, wherein the combustion chamber means comprises elongated conduit means within the refractory hearth structure means having a transverse sectional area and transverse width along at least most of the entire length thereof substantially less than the corresponding transverse sectional area and transverse width of the refractory hearth structure means to provide prolonged high temperature combustion within the refractory hearth structure means and wherein the induction system comprises air inlet valve means adapted to be selectively operated to a closed position thereof closing off inlet air therethrough to the combustion chamber means and to an open position thereof admitting inlet air for generally downdraft combustion of the solid fuel from generally the bottom of the fuel charge within the fuel charge chamber, and outlet blower means connected to the outlet of the heat exchanger and adapted to be selectively energized for selectively conducting the gaseous products of combustion from the heat exchanger and thereby also induce inlet air through the air inlet valve means, when in its open position, to the combustion chamber means, and control means having a solid fuel mode of operation for selectively opening the air inlet valve means to its open position and energizing the outlet blower means to effect a solid fuel combustion cycle within the heating apparatus and in the alternative an auxiliary fuel burner mode of operation, for selectively energizing the outlet blower means and auxiliary fuel burner to effect an auxiliary fuel combustion cycle within the heating apparatus.

34. A heating apparatus according to claim 21 or 33 wherein the control means comprises manual override means for opening the air inlet valve means to its open position and energizing the outlet blower means to effect a solid fuel combustion cycle.

35. A heating apparatus according to claim 33 wherein the control means comprises manual selector means for manually alternatively selecting said solid fuel and auxiliary fuel burner modes of operation of the heating apparatus, and automatic switchover means operative when the manual selector means is in the solid fuel mode of operation for automatically switching the heating apparatus to the auxiliary fuel burner mode of operation when the boiler temperature reaches a predetermined minimum temperature.

* * * * *